US010610920B2

(12) United States Patent
Levey et al.

(10) Patent No.: US 10,610,920 B2
(45) Date of Patent: Apr. 7, 2020

(54) MULTI-STATION RECIPROCATING DIE ROLL FORMING MACHINE

(71) Applicant: Illinois Tool Works Inc., Glenview, IL (US)

(72) Inventors: Kenneth R. Levey, Winfield, IL (US); Thomas S. King, St. Charles, IL (US); Michael J. Marchese, III, Chicago, IL (US); Daniel A. Dechant, Woodstock, IL (US)

(73) Assignee: Illinois Tool Works Inc., Glenview, IL (US)

( * ) Notice: Subject to any disclaimer, the term of this patent is extended or adjusted under 35 U.S.C. 154(b) by 320 days.

(21) Appl. No.: 15/552,572

(22) PCT Filed: Mar. 24, 2016

(86) PCT No.: PCT/US2016/023863

§ 371 (c)(1),
(2) Date: Aug. 22, 2017

(87) PCT Pub. No.: WO2016/160464

PCT Pub. Date: Oct. 6, 2016

(65) Prior Publication Data

US 2018/0333766 A1 Nov. 22, 2018

Related U.S. Application Data

(60) Provisional application No. 62/140,686, filed on Mar. 31, 2015.

(51) Int. Cl.

| | |
|---|---|
| ***B21H 3/06*** | (2006.01) |
| ***B21H 5/02*** | (2006.01) |
| ***B21H 9/02*** | (2006.01) |

(52) U.S. Cl.

CPC ..... *B21H 3/06* (2013.01); *B21H 5/027* (2013.01); *B21H 9/02* (2013.01)

(58) Field of Classification Search

CPC . B21H 3/06; B21H 5/027; B21H 9/02; B21H 3/04; B21H 3/00; B21H 3/02; B21H 3/022; B21H 3/025; B21H 3/027

(Continued)

(56) References Cited

U.S. PATENT DOCUMENTS

| | | | |
|---|---|---|---|
| 2,262,698 | A | 11/1941 | Herve |
| 3,952,884 | A | 4/1976 | Babiarz |

(Continued)

FOREIGN PATENT DOCUMENTS

| | | |
|---|---|---|
| CN | 2724879 | 9/2005 |
| CN | 103846375 | 6/2014 |

(Continued)

OTHER PUBLICATIONS

International Search Report and Written Opinion for PCT/US2016/023863.

*Primary Examiner* — Teresa M Ekiert
(74) *Attorney, Agent, or Firm* — Quarles & Brady LLP

(57) ABSTRACT

A multi-station, reciprocating die pattern forming machine (500), including a pair of parallel reciprocal slide members (502, 503) with spaced pairs of pattern forming dies (504) thereon reciprocal between an insert position and an eject position. Drive mechanism (505, 506, 510) reciprocates the die pairs alternately between the insert position and eject position. Mechanism delivers and positions a pattern receiving blank (600) to a pair of dies when in the insert position. Axial translation of the dies causes the dies to rotate the blank at a center of process and impart a pattern upon the blank. Servo-motors on blank positioning mechanism provide feedback recognition of the position of the blanks during processing. The invention also relates to a method of patterning blanks.

19 Claims, 10 Drawing Sheets

(58) Field of Classification Search
USPC ..... 72/103
See application file for complete search history.

(56) References Cited

U.S. PATENT DOCUMENTS

| | | | | | |
|---|---|---|---|---|---|
| 4,712,410 | A * | 12/1987 | Killop | B21H 3/022 | 72/108 |
| 4,852,375 | A * | 8/1989 | Killop | B21D 53/28 | 72/88 |
| 6,248,020 | B1 * | 6/2001 | Morath | B21K 1/44 | 470/110 |
| 6,301,945 | B1 * | 10/2001 | Roseliep | B21H 5/027 | 72/88 |
| 9,919,355 | B2 * | 3/2018 | Levey | B21H 3/06 | |

FOREIGN PATENT DOCUMENTS

| | | |
|---|---|---|
| CN | 104117611 | 10/2014 |
| EP | 1166916 | 1/2002 |
| JP | S55 153642 | 11/1980 |
| JP | H06 79385 | 3/1994 |
| WO | WO 2014/151132 | 9/2014 |

* cited by examiner

MULTI-STATION RECIPROCATING DIE ROLL FORMING MACHINE

CROSS-REFERENCE TO RELATED APPLICATIONS

This application is a National Phase of International Application No. PCT/US2016/023863, filed Mar. 24, 2016. which claims priority pursuant to Title 35 USC § 119(e) to U.S. Provisional Application No. 62/140,686, filed Mar. 31, 2015, entitled, "Multi-Station Reciprocating Die Roll Forming Machine," the entire contents of which are hereby incorporated by reference as if fully set forth herein.

BACKGROUND OF THE INVENTION

The present disclosure relates to cold forming machines employing reciprocal dies to form a pattern on a cylindrical blank rotating about a fixed axis. More particularly, it relates to such machines having multiple blank feeding stations.

Cold forming machines utilizing reciprocal dies to pattern a cylindrical blank rotating about a fixed axis have recently evolved to take advantage of modern machine technology. The advent of servo-motors, belt drives, light weight slides with re-circulating bearings, and computer-based controls have made such machines a reality. The present invention presents refinements and advances to provide commercially viable technology as a competitive alternative to traditional cold forming equipment. Though illustrated here in the context of cold rolled thread forming, such equipment is suitable for any similar application, including forming toothed gears or the like.

PCT Publication WO 2014/151132 A2 reflects the leading edge in this technology. The content of that disclosure, including specification, claims and drawings is hereby incorporated by reference in this application as if fully set forth herein.

Advances disclosed in this application involve refinements advantageous to a multiple station configuration. They involve blank feeding, stroke length optimization, use of different die sizes, longitudinal die spacing, and preset modular forming elements, as well as mechanism for transverse die clearance adjustment. These improvements are best understood in reference to the embodiments described below and illustrated in the accompanying drawings.

DETAILED DESCRIPTION OF THE INVENTION

Figure 1:
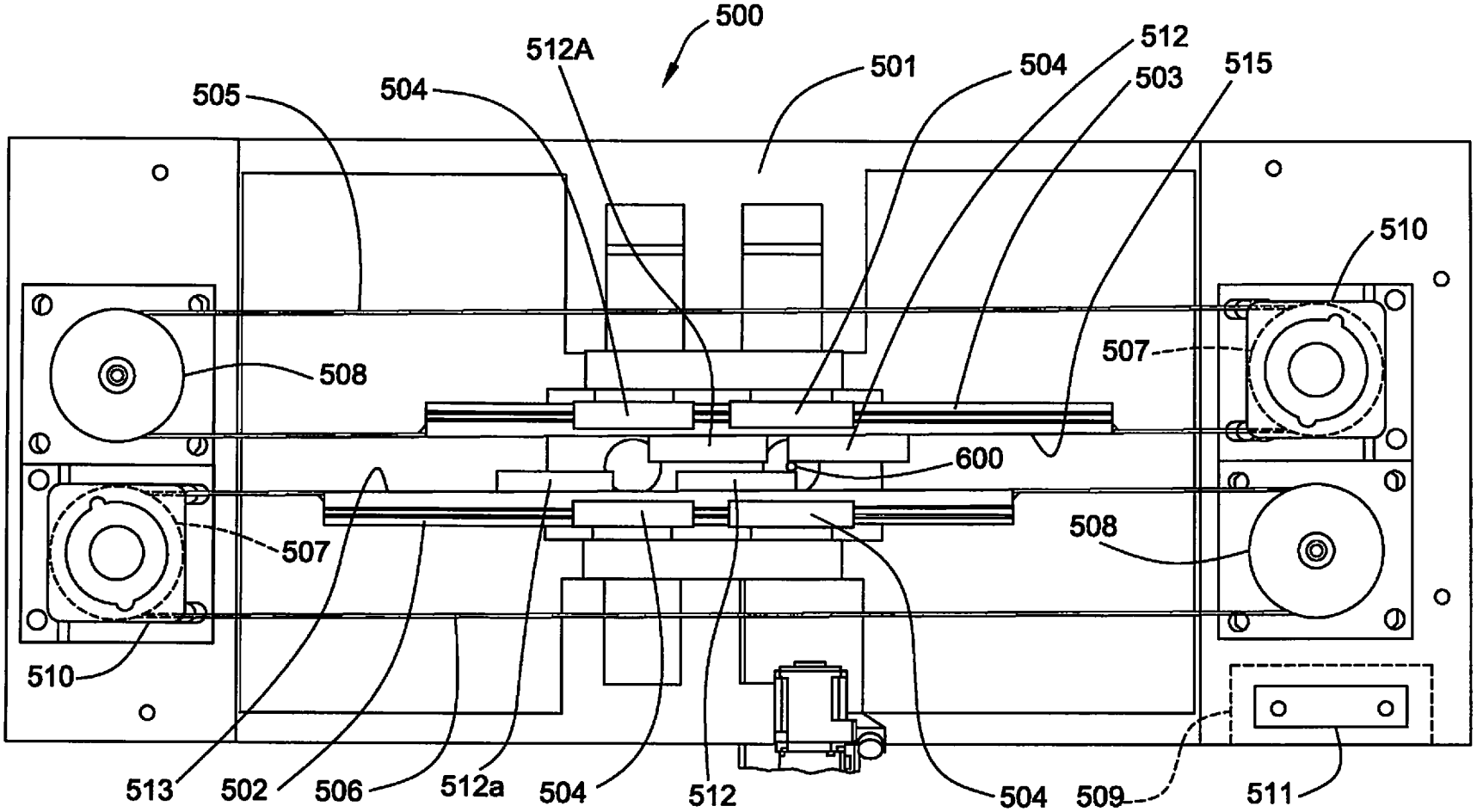
FIG. 1 illustrates a top view of a multi-station, reciprocating die, roll forming machine of the present disclosure.
Figure 2:
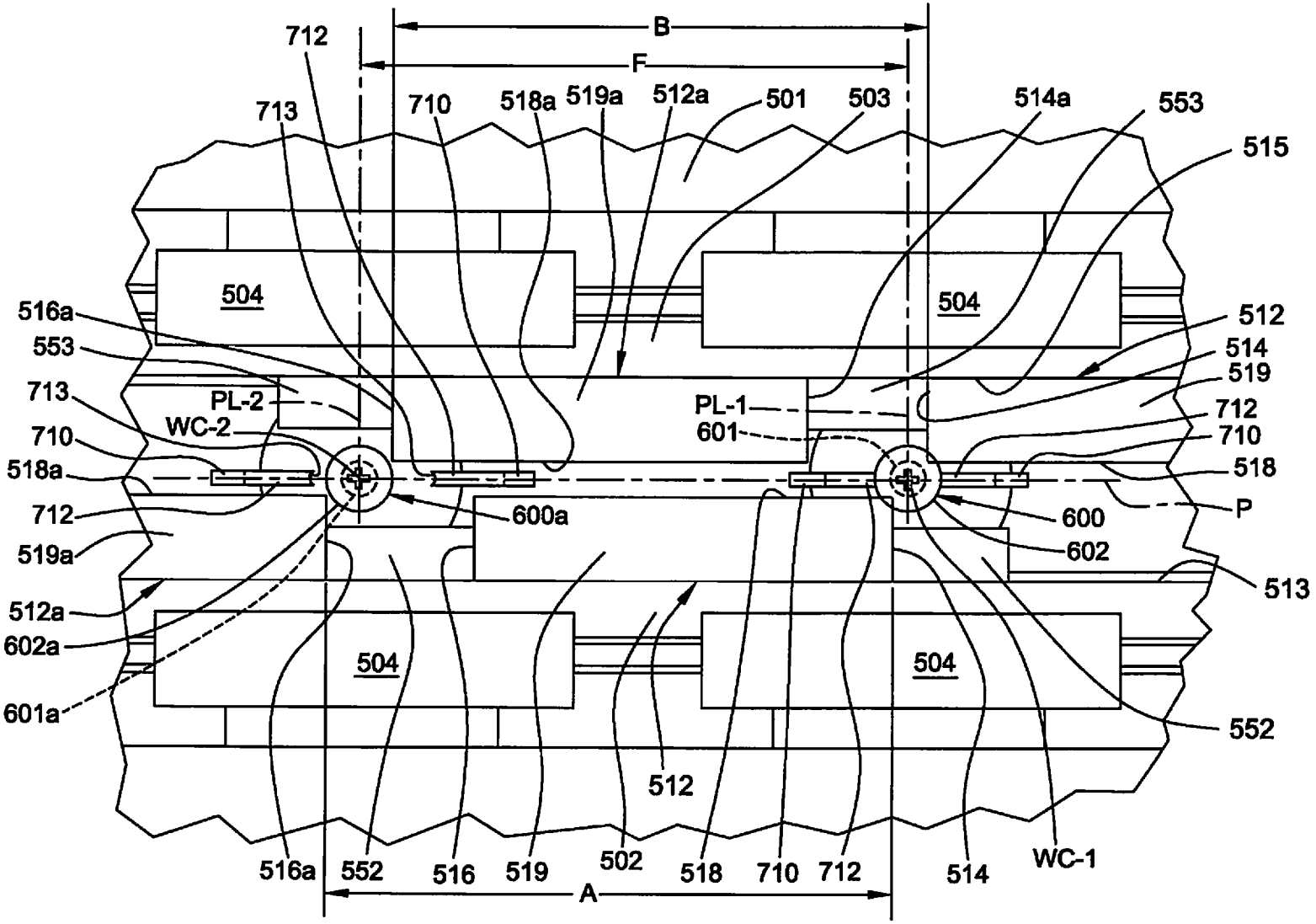
FIG. 2 is a partial top view, on an enlarged scale, of the multi-station reciprocating die, roll forming machine shown in FIG. 1 illustrating various features in particular reference to die spacing.

FIGS. 1 and 2 illustrate a multi-station reciprocating die roll forming machine of the present disclosure. The machine of this embodiment includes two separate servo-motor and belt drive systems for parallel, reciprocating slides of the machine, each carrying one die of each of two die sets.

For simplicity of understanding the basic machine operation, the illustrated embodiment is described in the context of manufacturing a threaded machine screw from a blank. The disclosed machine, however, is useful to form any desired pattern on a cylindrical blank attainable by roll forming.

Referring to FIGS. 1 and 2 the illustrated multi-station reciprocating die roll forming machine 500 includes a base 501 that supports opposed bearing blocks 504. The bearing blocks 504, in turn, support elongate rails 502, 503 slidable along spaced paths parallel to and equidistant from longitudinal plane "P", shown in FIG. 2.

In this embodiment, the slidable rails 502 and 503 are each driven by a toothed belt 505 and 506 best seen in FIG. 1. As shown, belts 505 and 506 each include ends affixed to the ends of one of the rails 502 and 503. Belts 505 and 506 are supported on base 501 for reciprocal drive by separate, reversible servo-motors 510. Each belt 505 and 506 passes around a toothed pinion or sprocket 507 driven by one of the motors 510. Each separate belt extends around an idler pulley 508 rotatably supported on base 501. Forward and reverse rotation of either servo-motor 510 causes the associated belt to axially translate one of the slidable rails 502 or 503 supported on bearing blocks 504 independently of the other.

The operation of servo-motors 510 is controlled by a central processing unit (CPU) 509 responsive to software that receives instruction from an operator touch screen panel 511. Input from the operator station can position the slidable rails 502 and 503 as needed to insure that forming upon a blank commences with the dies properly aligned relative to the blank to be formed and to each other, to impart a desired pattern on the outer pattern receiving surface of the blank. The input controller can also set the length of the path or stroke of the reciprocating slidable rails 502 and 503 as well as synchronize movement of slidable rails 502 and 503 and hence the associated forming dies as well as control all other functions of the machine.

The reciprocating die roll forming machine of the embodiment of FIGS. 1 and 2 includes two stations designated WC-1 and WC-2 where blanks are delivered for cold forming.

Notably, the respective blanks 600 and 600*a* illustrated include an elongate, cylindrical pattern receiving surface 601 and 601*a* and an enlarged head portion 602 and 602*a*. The machine 500 is configured to produce two completed roll formed products from two blanks processed sequentially in one complete reciprocation or cycle of operation. A complete cycle of operation is movement of the slides or rails 502 and 503 from one preset longitudinal extent of travel to the preset longitudinal extent of travel in the opposite direction, and return.

The machine 500 includes two sets of reciprocating dies 512 and 512*a*. One die of each set of dies 512 and 512*a* is carried by one of the rails 502 and 503. The dies are contained in die holders 552 and 553 illustrated generally in FIG. 2 and discussed in detail below in reference to FIGS. 4 through 8.

Each die set is arranged to roll a spiral thread (or other desired pattern) on cylindrical blank 600 and 600*a* during each reciprocation cycle. The die faces 518 and 518*a* containing the pattern to be imparted to the cylindrical pattern receiving surface of a blank are disposed in opposed facing relation and traverse a parallel path of reciprocation equidistant from and on opposite sides of vertical longitudinal plane P. The die faces 518 and 518*a* include a pattern of thread forming ridges to impart the thread form to the pattern receiving cylindrical surface of blank 600 or 600*a*. The die faces 518 and 518*a* are spaced apart a distance such that with their respective leading edges positioned in face-to-face relation transversely across plane P, the forming pattern on each die engages the outer surface of the cylindrical pattern receiving surface of the interposed blank 600 or 600*a*.

The cylindrical blank to be threaded is positioned with its longitudinal center line at the working center of the process WC-1 or WC-2 equidistant from the leading edge 514 or 514*a* of each die of a set associated with the center of process. As the dies move, the leading edges 514 or 514*a* of the die face patterns engage the outer cylindrical surface 601 or 601*a* of the blank at diametrically opposite surfaces along transverse plane of contact "PL-1 or PL-2" perpendicular to longitudinal plane P and passing through the working centers of process WC-1 or WC-2.

As the dies 512 or 512*a* of the associated die set move past each other along the path defined by plane P, the blank 600 or 600*a* becomes captured between the die faces 518 or 518*a*. As the blank 600 contacts both dies it commences to rotate about its vertical center due to contact of its outer surface with the faces 518 or 518*a* of both dies of the set.

As movement of the dies 512 or 512*a* continues, the die faces pass each other along plane P. The blank is supported by engagement with the die faces 518 and 518*a* and remains in a fixed location rotating about its vertical center as the dies engage its outer peripheral surface. The thread forming dies deform the peripheral surface of the pattern receiving surface of blank 600 or 600*a* to form the thread pattern.

The length of each die 512 or 512*a* between leading edge 514, 514*a* and trailing edge 516, 516*a* is sufficient for the blank 600 to complete four or five revolutions as it is rolled between die faces. The thread form pattern on the die faces is oriented such that the pattern on a die face is displaced one hundred eighty degrees (180°) relative to the other die face. This relationship is, of course, necessary to impart the appropriate deformation to the blank at diametrically opposite contact locations as the blank is rotated.

In a properly aligned relationship, the blank 600 or 600*a* rotates about the blank longitudinal center at the working center of the process WC-1 or WC-2 and remains longitudinally stationary relative to longitudinal plane P. If, during rolling of a thread pattern, longitudinal movement of the blank occurs, it is an indication that there is a malfunction and that unsatisfactory results are occurring. The disclosed machine 500 includes mechanism to sense such longitudinal movement and take appropriate action as discussed later.

Note that the illustrated reciprocating dies are oriented vertically. The blank is similarly positioned with its longitudinal axis disposed vertically. This orientation lends itself to vertical feed for loading and discharge of the blank between the reciprocating dies. Other orientation of the dies such as horizontal may also be employed.

As illustrated in FIGS. 1 and 2, dies 512 form a pattern on a cylindrical blank 600 at the center of process WC-1 as the dies of the rail 502 move from the left to the right as viewed in the Figs., and the dies on the rail 503 move from right to left. The dies 512*a* function identically to the dies 512 to form a pattern on a cylindrical blank 600*a* located at the second center of process WC-2, when the rail 502 moves in the opposite direction (right to left in FIG. 2, with rail 503 moving from left to right).

The two working centers of the process are spaced apart such, and the position of the leading edges 514*a* of the dies are such that the second set of dies 512*a* functions in the same manner as explained in reference to the dies 512, except when the longitudinal reciprocal movement is in the opposite direction. As can be appreciated, when blank 600 is being loaded at center of process WC-1 a completed part is being discharged at center of process WC-2. Similarly, when blank 600*a* is being loaded at center of process WC-2, a completed part is being discharged at center of process WC-1.

The dies 512 or 512*a* of a set mounted on rails 502 and 503 driven by servo-motors 510 are programmed, using panel 511 to reciprocate between an "insert position" and an "eject position." These positions represent the programmed extent of travel of the dies during the reciprocation cycle of rails 502 and 503 in one direction. The insert position is a position in which the leading edges of the dies of a set are spaced apart a distance to receive a delivered blank at the working center of process WC-1 or WC-2. The eject position is a position in which the trailing edges of the dies of a set are spaced apart a distance to permit a completed rolled part to discharge from the die set after completion of the rolling function. In each position, the edges of the dies of a set are equally spaced from the center of process WC-1 or WC-2 and consequently transverse planes PL-1 and PL-2. When in the insert position the distance between the leading edge of the die to transverse plane PL-1 or PL-2 is its "insert clearance." When in the eject position, the distance between the trading edge of the die and transverse plane PL-1 or PL-2 is its "eject clearance." (Though the eject clearance need not be equal to the insert clearance, as is discussed further below.)

The machine 500 illustrated in the drawings is programmed such that when rail 502 is at the programmed extent of its travel to the left (as viewed in FIGS. 1 and 2) and the rail 503 is at its programmed extent of travel to the right, the dies of set comprising dies 512 are in the insert position relative to the center of process WC-1 and the dies of the set comprising dies 512*a* are in the eject position relative to the center of process WC-2.

Similarly, when the rail 502 is at the programmed extent of travel to the right and the rail 503 is at its programmed extent of travel to the left, the dies of the die set 512 are in the eject position relative to the center of process WC-1 and the die set comprising the dies 512*a* are in the insert position relative to center of process WC-2.

It should be understood that the die sets could be mounted to the slides or rails 502 and 503 such that when the rail 502 was at the programmed extent of travel to the left (as viewed in FIGS. 1 and 2) and the rail 503 at the programmed extent of travel to the right, the dies 512 would be in their eject positions and the dies 512*a* would be at their insert positions. The particular configuration illustrated and described was adopted for descriptive purposes and not by way of limitation.

From the foregoing description it is readily understood that the length of the path of travel of each die exceeds the longitudinal length of each of the dies. The stroke or longitudinal movement of slides 502 and 503 between their longitudinal extent of travel is dictated by the length of the die and the clearance required at the spaced working centers of process WC-1 and WC-2. The hypothetical or optimal minimum stroke length in one direction, i.e., to the right from the left in FIG. 2 (or from the left from the right) includes the length of the die plus its insert clearance and its eject clearance.

Stroke of the rails 502 and 503 is readily controlled through the central processing unit (CPU) 509 and control panel 511 by adjustment of servo-motors 510. The diameter of the cylindrical pattern receiving surface 601 or 601*a*, as well as the diameter of the head 602 or 602*a* of the blank 600 or 600*a* are readily determined to establish the spacing needed between the dies of each set at the insert and eject positions.

As can be appreciated, other factors inherent in the rolling function influence the actual minimum "practical" stroke length. For example, the discharge of a finished part from the centers of process WC-1 or WC-2 relies on gravity once the part disengages from the working faces 518 or 518*a* of the dies. Its length may influence the period of time required to safely clear it from the path of the reciprocating dies. Also, there exists significant longitudinal (along plane P) forces on the dies during metal deformation of the rolling blanks 600 and 600*a*. Such loads must be accommodated by the structure that connects the dies to the reciprocating rails 502 and 503. This aspect of the construction of the roll forming equipment is discussed in greater detail below.

For purposes of positioning and retaining a blank 600 or 600*a* in place until contact is made by the leading edges 514 or 514*a* of the dies 512 or 512*a* with the outer cylindrical surface 601 or 601*a* of the blank at transverse plane PL-1 or PL-2, each die of sets 512 or 512*a* includes an upper planar surface 519 or 519*a*. The size of enlarged head 602 or 602*a* of blank 600 is such that the blank is captured and supported by the two upper planar surfaces 519 or 519*a* with the pattern receiving surface between faces 518 or 518*a*. Thus when a blank is inserted it is vertically positioned relative to the pattern forming die faces 518 or 518*a*.

As illustrated in FIG. 2, right side at working center of process WC-1, enlarged head 602 of the blank 600 is captured upon the upper planar surfaces 519 of dies 512. This fixes the vertical position of the blank 600 relative to the pattern forming faces 518 of dies 512. Notably in stances where the blank length dictates that the enlarged head position be vertically elevated relative to the upper planar surfaces 519 of the dies 512, other solutions are available. One approach is illustrated in previously mentioned PCT Publication No. WO 2014/1511132 A2. It comprises blocks 120, 120*a* with horizontal stop surfaces 122 and 122*a* discussed in paragraphs [0041] and [0042] of that publication. Another option would be in reference to FIGS. 1 and 2 of this application, to attach a spacer block to the upper planar surfaces 519 and 519*a* of the dies of sets 512 and 512*a* for engagement with the under surface of a head 602 or 602*a* of a blank, to limit the permitted vertical insertion of the blank 600 or 600*a* at WC-1 and WC-2. Other arrangements for vertical positioning a blank are disclosed later.

A final orientation of the blank relative to the leading edges 514 or 514*a* of dies 512 or 512*a* is achieved by engagement of the blank 600 by blank delivery and positioning mechanism locating fingers 710. In this regard, it is contemplated that the reciprocating die pattern forming machine 500 of FIGS. 1 and 2 includes a blank delivery and positioning mechanism associated with each working center of process, WC-1 and WC-2. Such a blank delivery and positioning mechanism could be configured as described in the PCT Publication WO 2014/151132 A2 or as illustrated in connection with the embodiment of FIGS. 10, 11 and 12 of this disclosure, discussed below.

The delivery system could include any suitable arrangement to unitarily and sequentially feed a blank 600 or 600*a* to the working centers of process WC-1 and WC-2 at the appropriate time in the reciprocation cycle. The delivery and positioning system would be synchronized with the reciprocal movement of slide rails 502 and 503 and would be operated by the computer 509 with input from the operator control panel 511.

Figure 3:
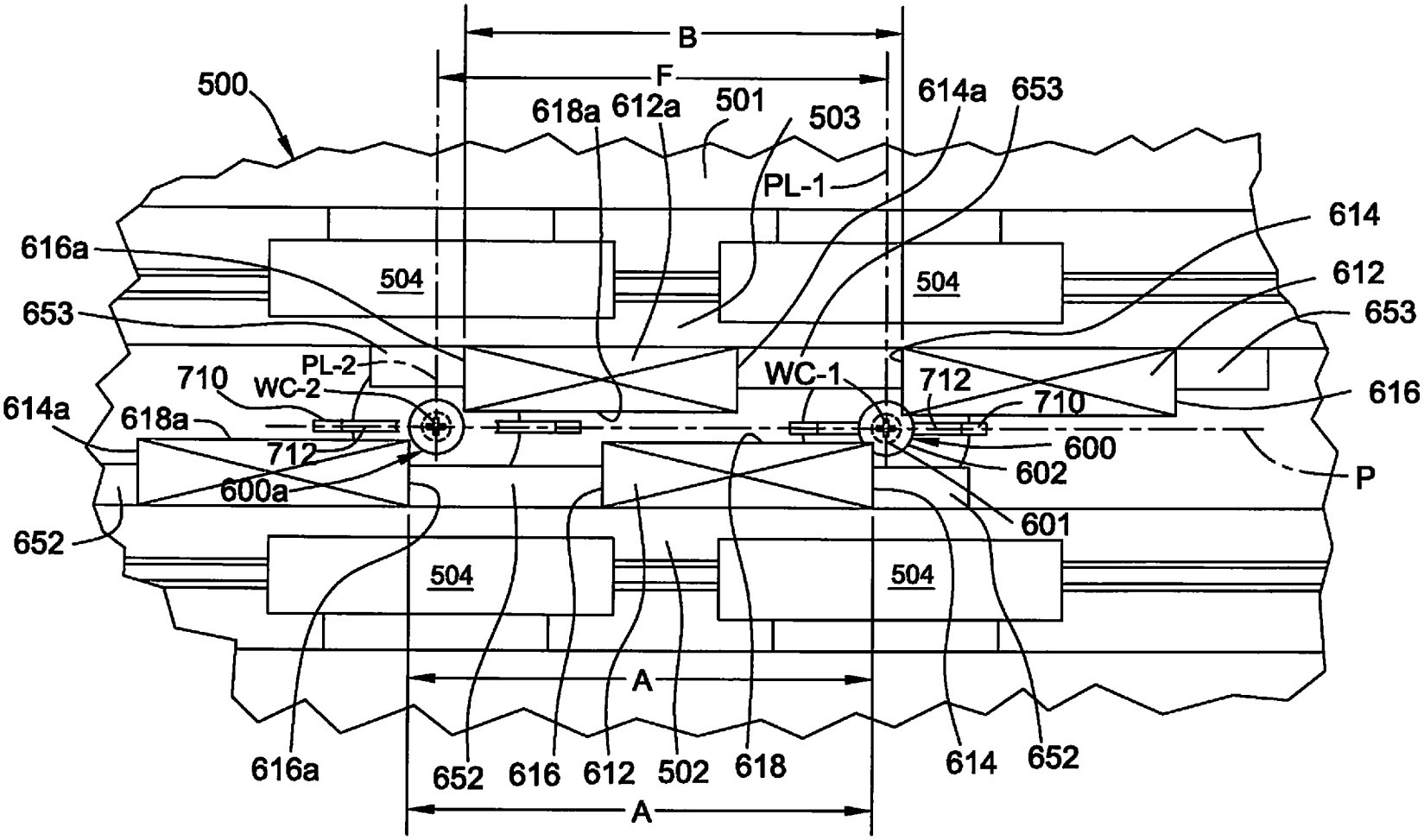
FIG. 3 is a partial top view, on an enlarged scale, of the multi-station, reciprocating die, roll forming machine shown in FIG. 1, illustrating die spacing with dies of a size that differs from the dies illustrated in FIGS. 1 and 2.

Referring to FIGS. 1 to 3, it is contemplated that the blank delivery and positioning mechanism include a pair of pivotally mounted locating arms 710 with locating fingers 712 having supported facing curved ends 713. The arms 710 are mounted for movement toward and away from each other as best described in greater detail below.

Referring to FIG. 2, right side, at center of process WC-1, when a blank 600 is delivered for pattern forming, the arms 710 pivot toward each other. The facing ends 713 of locating fingers 712 contact the outer cylindrical pattern receiving surface 601 of blank 600 and align the longitudinal centerline of the blank with the working center of process WC-1. The blank is vertically positioned relative to the die faces 518 because the enlarged head 602 of the blank 600 is supported by the upper planar surfaces 519 of the dies 512.

The curved facing ends 713 of locating fingers 712 maintain the blank positioned relative to the center of process until the leading edges 514 of the patterned faces 518 of the dies 512 engage the cylindrical pattern receiving surface 601 of the blank 600 at diametrically opposite surfaces along transverse plane PL-1. The locating arms 710 are then pivoted to move locating fingers away from each other and separate the curved facing ends 713 from positioning support. The continued axial translation of slidable rails 502 and 503 causes the dies 512 to roll the blank 600 about its longitudinal centerline to impart the thread pattern to the blank 600.

The machine 500 illustrated in FIGS. 2 and 3 includes two sets of pivotal locating arms 710, one set associated with each working center of process WC-1 and WC-2. Each works identically to position a blank 600 or 600*a* with respect to the working center WC-1 or WC-2 to coact with the dies 512 or 512*a* at the appropriate time. Note also, that in this embodiment the pivotal support of the locating arms 710 is below the sliding rails 502 and 503. The locating fingers 712 and curved facing ends 713 operate below the upper planar surfaces 519 of the dies 512. Thus, the thickness of these components must be less than the transverse or lateral spacing between the pattern forming faces 518 or 518*a* of the dies 512 and 512*a*.

Proper location of the individual thread forming dies upon the reciprocating slides 502 and 503 assures maximization of machine utilization and efficiency. In this regard, it has been recognized that essential to such capability is an asymmetric spacing of the dies on one slide relative to the other. To differentiate between the die positioning on rails 502 and 503, it is noted that the dies 512 and 512*a* on rail 502 are positioned with their respective trailing edges 516 and 516*a* adjacent each other. The dies 512 and 512*a* on rail 503 are positioned with their leading edges 514 and 514*a* adjacent each other. Of course this arrangement could be reversed, with the dies having adjacent trailing edges on rail 503 and the dies on rail 502 positioned with adjacent leading edges.

In reference to FIG. 2, optimally the distance A between the leading edge 514 of die 512 on slide 502 and trailing edge 516*a* of die 512*a* on slide 502 should equal the distance "F" between the blank feeding stations at planes PL-1 and PL-2 minus the insert clearance of die 512 plus the eject clearance of die 512*a* ("F" plus difference between insert clearance and eject clearance). At the same time, optimally the distance "B" between the leading edge of die 512 on slide 503 and the trailing edge 516*a* of die 512*a* on slide 503 should equal the distance "F" plus the insert clearance of die 512 minus the eject clearance of die 512*a*. ("F" minus difference between insert clearance and eject clearance).

Thus, in the arrangement illustrated in FIG. 2, the die of each set 512 and 512*a* attached to rail 502 by die holder 552 are spaced further apart than the dies 512 and 512*a* on rail 503. The total difference is twice the difference between insert clearance and eject clearance.

Another important aspect of the multi-stage reciprocating roll forming machine of the present disclosure is the capability to utilize forming dies of different length. In this regard, thread rolling dies formerly employed in conventional thread rolling machines are available in various lengths depending on the diameter of the blank to be formed. For example, the length of a Number 20 stationary die is 6.0 inches and the length of a Number 30 die is 7.5 inches.

The machine 500 illustrated in FIG. 2 illustrates an arrangement utilizing Number 30 stationary dies. Employing the principles discussed above, the same machine 500 is illustrated in FIG. 3 equipped with Number 20 dies. The dies are connected to rails 502 and 503 for reciprocal translation utilizing die holders 652 and 653 configured to accommodate the Number 20 dies identified as sets 612 and 612*a*.

The dies of shorter length 612 and 612*a* are installed with set 612 positioned in the insert position relative to WC-1 with the leading edges 614 of that set spaced from plane PL-1 the length of the insert clearance and the other set 612*a* positioned relative to WC-2 in the eject position with the trailing edges 616*a* of that set spaced from plane PL-2 the length of the eject clearance. Necessarily, in the arrangement illustrated in FIG. 3, the distance, or spacing between adjacent edges of the dies on a given rail 502 and 503 increases by the amount of the difference in length of the dies as compared to the spacing between dies on rails 502 and 503 illustrated in FIG. 2.

With the shorter dies, the control of the machine is reset to establish a reciprocating stroke equal to the length of the new shorter dies plus the length of the insert clearance and the length of the eject clearance, plus any additional clearance deemed desirable for overall machine function consistent with efficient operation. It should be recognized that the use of shorter dies generally results in shorter stroke length and consequently a faster overall cycle time.

It should be noted that machine 500 of the present disclosure is also capable of operating with longer size dies. In such an instance, only one feed station (WC-1 or WC-2) may be employed during roll forming of parts using a longer die set. An example of a suitable die size would be Number 50 dies. These dies are nominally 11.0 inches in length. Such dies could be attached to slides 502 and 503 (using appropriately configured die holders) with the leading edges 514 spaced to define an insert clearance relative to working center of process WC-1 or WC-2. The stroke length of the slides 502 and 503 would then be adjusted using controls 511 for processor 509 to place reciprocal movement about the working center of process (WC-1 or WC-2). The length of the stroke of the reciprocal slides would then be adjusted to 11.0 inches plus the insert clearance and eject clearance relative to the plane PL-1 or PL-2, plus any additional distance necessary to accommodate proper overall machine function.

Figure 4:
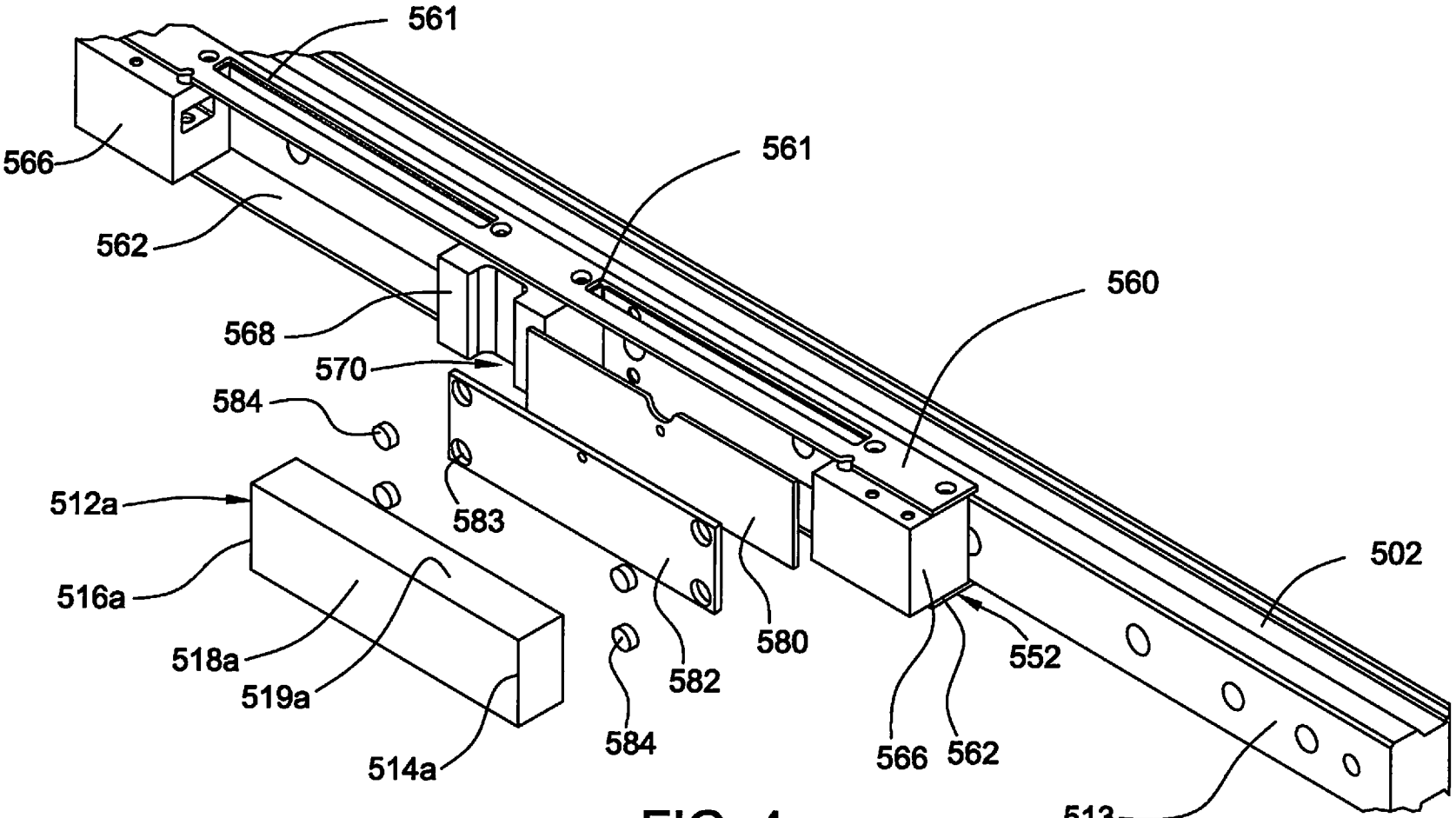
FIG. 4 is a perspective exploded view showing details of the die holders that attach the dies to the machine slides.

Turning now to FIG. 4, the details of the die holders that attach the dies to slides or rails 502 and 503 are illustrated in greater detail. FIG. 4 is an expanded view showing rail 502 and die holder 552 in association with die 512*a* of FIG. 2. This description is considered representative of, and applicable to the slide rails, die holders and dies of the arrangements of FIGS. 2 and 3 and 5 through 8.

Rail 502 includes a planar face 513 parallel to longitudinal plane P in FIG. 2 when slidably attached to bearing blocks 504. Rail 503 has a corresponding planar face 515. With rails 502 and 503 supported on bearing blocks 504, faces 513 and 515 are disposed at equal distance from plane P, about 3.5 inches apart in this iteration of machine 500.

Figure 5:
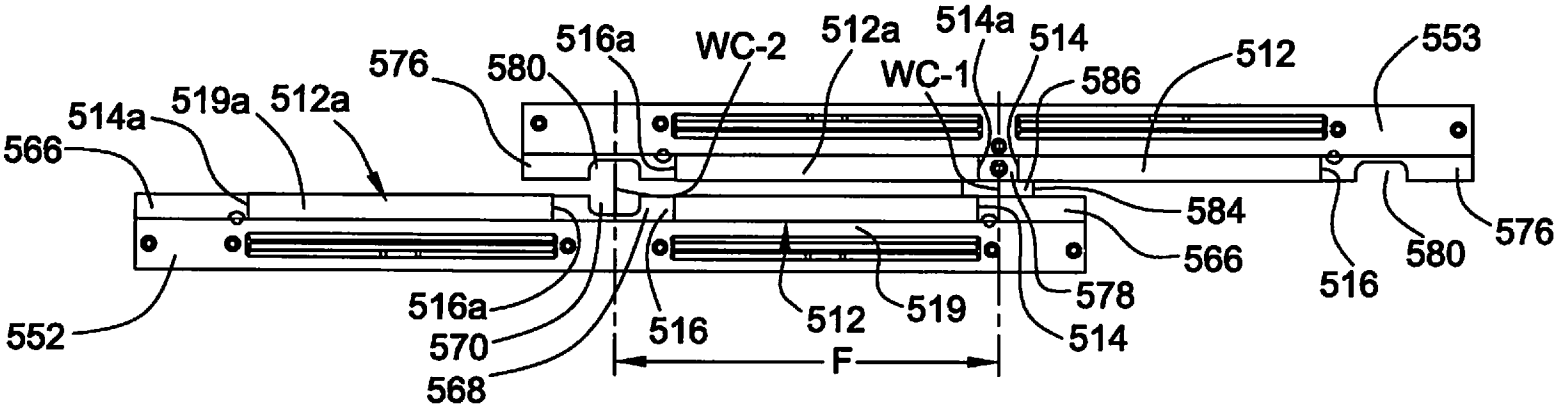
FIGS. 5 and 6 illustrate details of the die blocks positioned between dies of the machine of FIG. 1 mounted in the die holders that connect the dies to the slides or rails.
Figure 6:
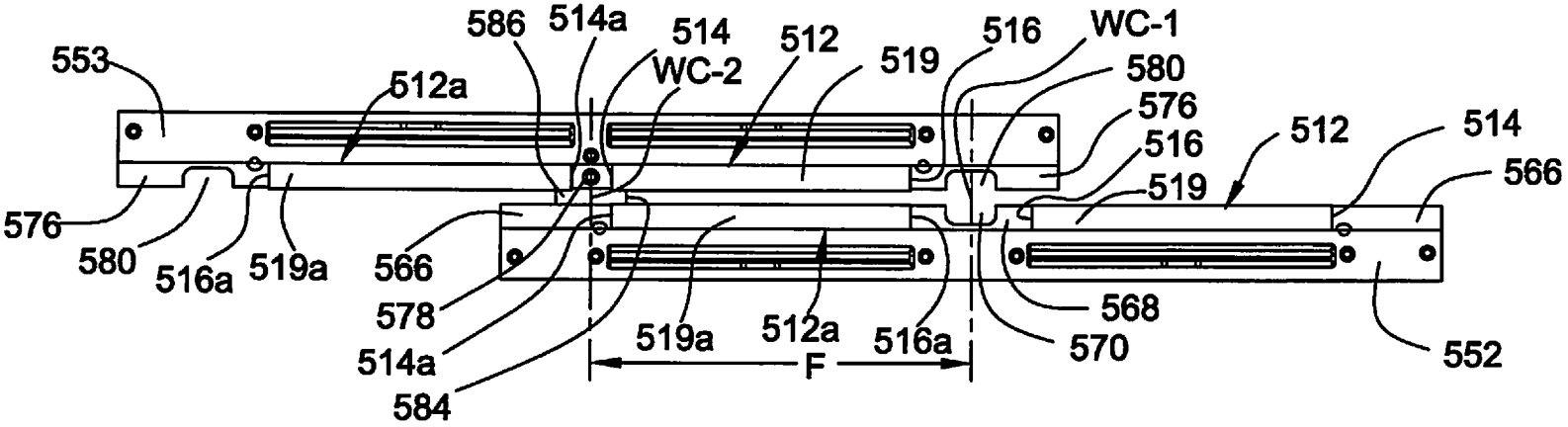

Referring to FIGS. 4, 5 and 6, the illustrated die holder 552, with installed dies 512 and 512*a* is affixed to rail 502 to support the dies on the rail for reciprocating travel. Similarly, die holder 553 with installed dies 512 and 512*a* is affixed to rail 503 to support the dies on the rail 503 for reciprocating travel. In reference to FIGS. 7 and 8, in the same general configuration, die holders 652 and 653 with installed dies 612 and 612*a* support the dies on rails 502 and 503 for reciprocating travel.

FIG. 4 is an exemplary illustration of the general configuration of the die holders employed the illustrated embodiments of FIGS. 1 to 3 and discussed in reference to FIGS. 5 to 8. Die holder 552 includes spaced apart longitudinal top plate 560 and bottom plate 562 connected by fasteners (not shown) to two end blocks 566 and a center block 568. Referring to FIGS. 5 to 8, to be discussed later, the die holders 553 and 653 connecting the dies to rail 503 include end blocks 576 and 676 and center blocks 578 and 678 that differ somewhat from those in holders 552 and 652 as will be explained.

Referring to FIG. 4, the blocks 566 and 568 define die receiving pockets sized to retain dies 512 and 512*a* against movement longitudinally of plane P or vertically relative to rail 502. Notably in reference to the configuration of FIG. 3, the pockets of die holder 652 are sized to retain dies 612 and 612*a* of reduced size as compared to the dies 512 and 512*a* of FIG. 2.

The die pockets have a height between top plate 560 and bottom plate 562 to receive a die such as die 512*a* illustrated in FIG. 4. Similarly, each has a length along rail 502 between edges of center block 568 and each end block 566 sufficient to receive a die of a given length. Dies 512, 512*a* or 612 and 612*a* are slid into a receiving pocket from its open end. Each die, for example, die 512*a* illustrated in FIG. 4, resides in its pocket with pattern forming face 518 somewhat protruding or extending outward toward plane P.

As can be appreciated, the relative transverse position of the pattern forming faces 518 and 518*a* (or 618, 618*a*) is critical to successful production of patterned roll formed parts from blanks 600, 600*a*. As seen in FIG. 4, top plate 560 includes an elongate slot 561 associated with each die pocket. It is provided for insertion and removal of transverse spacing adjustment elements as will be explained.

Die holder 552 is affixed to slide or rail 502 using appropriate threaded fasteners (not shown) between the rail and die blocks 566 and 568. Since the spacing between dies is a precision relationship, the size and relative position of the die pockets is controlled to close manufacturing tolerances, as is the ultimate affixation of the die holder 552 to the rail 502.

Note that the top plate 560 and bottom plate 562 are spaced apart sufficiently to overlap the top and bottom of longitudinal rail 502 with die holder 552 attached to the rail. The planar surface 513 of the rail 502 is aligned with the edge of slot 561 such that the planar surface 513 forms the bottom or closed inner end of each die pocket. This configuration provides access between the back surface of a die and the closed inner end of its associated die pocket for transverse spacing adjustment.

In this regard, and as illustrated in FIG. 4, a transverse adjustment mechanism is provided for each separate die of sets 512 or 512*a* (FIG. 2) as well as dies 612 or 612*a* (FIG. 3). It comprises a die back plate 580, a die shim plate 582 and a plurality cylindrical die shim buttons 584. These buttons may be provided in varying axial lengths or thickness from 0.2150 inches to 0.2350 inches in increments of 0.001 inch.

Back plate 580 is a steel plate that receives the transverse loads from its associated die generated by the roll forming process. It delivers those loads to the rail 502 or 503 which, in turn, passes the loads to the bearing blocks 504.

Die shim plate 582 includes four holes or receptacles 583, one near each corner of the plate. Holes 583 are sized to slidably receive one shim button. Plate 582 has a thickness less than the axial thickness of the shortest die button, i.e., less than 0.2150 inches. Shim buttons of desired axial length are placed into the four holes or receptacles 583 of shim plate 582 for providing controlled spacing between the back of the die and the die back plate 580.

To establish transverse spacing relative to planar P a die, for example die 512*a* of FIG. 4, is pushed into the die pocket with the back plate 580 resting against planar surface 513 of slide or rail 502. Notably, the distance between the surface 513 of rail 502 and the corresponding surface 515 of rail 503 is accurately established and maintained by the fixed positions of bearing blocks 504 discussed further below. The surfaces 513 and 515 serve as reference planes relative to longitudinal plane P for purposes of die setup for roll forming blanks 600 and 600*a*.

By selection of the appropriate combination of die buttons 584, accurate spacing of the pattern forming faces 518 and 518*a* is achieved. The buttons 584 are placed in holes 583 and urged into contact between die back plate 580 (which rests against planar surface 513 or 515) and the back face of the die 512 or 512*a*. The die is then fixed relative to die holder 552 using an available die clamp carried by the end block or center block of the die holder. Clamps useful to this connection are "Pitbull" clamps sold by Mitee-Bite Products Co., Center Ossipee, N.H. Slots 561 in top plate 560 provide access to the adjustment mechanism should it be necessary to alter the die button configurations after installation into the machine 500.

As illustrated in FIG. 4, center die block 568 of die holder 552 includes a vertical discharge, or ejection slot 570. As explained hereafter, such discharge slot is provided in association with the trailing edge of each die 512, 512*a*, 612 or 612*a*. To aid in understanding the configuration and principles involved in provision of ejection slots such as discharge slot 570 in association with each trailing edge reference is made to FIGS. 5 and 6. Here the die holders 552 and 553 of the embodiment of FIG. 2 are illustrated in positions of programmed travel of slides 502 and 503 with holders 552 to the left in FIG. 5 (as also seen in FIG. 2), and to the right in FIG. 6. FIG. 5 further illustrates the configuration of die holder 552 with end blocks 566 and center block 568 having discharge slot 570 as described and illustrated in reference to FIG. 4.

Also illustrated is die holder 553 on rail 503. It comprises top and bottom plates such as 560 and 562 connected between end blocks 576 and center block 578. Because die holder 553 retains dies 512 and 512*a* in position with leading edges 514 and 514*a* adjacent to each other, center block 578 does not require a discharge slot. Rather each end block 576 includes discharge slot 580 positioned relative to the trailing edge of a die 512 or 512*a* in the same relationship as the discharge slot 570 of center block 568 is to the trailing edges 516 and 516*a* of die 512 and 512*a* held on rail 502 by die holder 552. It should be noted that the center block 568 of die holder 552 includes one ejection slot 570 because the trailing edges of dies 512 and 512*a* on rail 502 are adjacent to each other. Die holder 553 includes an ejection slot 580 in each end block 576. This configuration places an ejection slot adjacent the trailing edge 516 or 516*a* of each of the dies of sets 512 and 512*a* mounted in die holder 553.

The provision of a discharge slot in the blocks of the die holder derives from the strength requirement of the blocks. As can be appreciated during roll forming, the dies 512, 512*a* experience significant forces in both the transverse and longitudinal directions (relative to plane P). As the dies 512, 512*a* engage and deform the cylindrical pattern receiving surface 601 or 601*a* of the blank 600 or 600*a* the dies experience resistance to continued longitudinal movement along plane P. That load is delivered to the sliding rails 502 and 503 through the blocks of die holders 552 and 553. For example, in reference to FIGS. 2, 4 and 5, the die holder 552 receives such load at center block 568, which must be of sufficient strength to receive it and transfer it to the bearing blocks 504 through rail 502.

Similarly, on rail 503 the longitudinal load is received by one of the end blocks 576 of holder 553 depending on the direction of reciprocation. Thus, the holder blocks 576 of die holder 553 must also be of sufficient strength to handle the forces experienced during forming.

The foregoing requirements result in a physical size for the blocks that would block discharge of the completed part at the working center WC-1 or WC-2 when the die sets are in the "optimum" eject position (at "ejection clearance" relative to planes PL-1 and PL-2). Consequently, the center block 568 is designed with sufficient strength to withstand the forces of the blank deformation process. The block 568 is provided with a discharge slot 570 centered between the trailing edges 516 and 516*a* of dies 512 and 512*a*. The travel or stroke of the machine 500 is arranged accordingly. That is, its length is sufficient to place the transverse mid-line of discharge slot 570 at the working center of process WC-1 or WC-2 when the rail 502 is at its programmed extent of travel in a given direction.

Similarly, the discharge slot 580 of end blocks 576 is arranged to align with discharge slot 570 across plane P when the rail 503 is in the programmed extent of travel in the opposite direction. As can be appreciated, the length of stroke of the reciprocating rails is increased somewhat as compared to the optimal minimum length stroke previously discussed to accommodate the longitudinal length of the center block 568.

With the discharge slots 570 and 580 aligned at the programmed extent of stroke of rails 502 and 503, ejection slots are bisected by the transverse plane PL-1 or PL-2 at the working center of process WC-1 or WC-2. When in this position, they define a passage of sufficient size to permit discharge of a completed part from the center of process. That is to say, the ejection slot 570 on center block 568 of die holder 552 aligns with one of the ejection slots 580 of one of the end blocks of 576 of die holder 553 at each working center of process WC-1 and WC-2 as the rails reach the programmed extent of travel in a given direction. The ejection slots 570 and 580 are configured to be bisected by the planes PL-1 and PL-2 when the rails 502 and 503 are at the programmed extent of travel in one direction and form a discharge passage for purposes of passing a completed roll formed part.

It should also be noted that because of the required strength of the block or mass of the die block, for example center block 568 on die holder 552, and consequent size, the trailing edges 516 and 516*a* of dies 512 and 512*a* are spaced from the working center of process WC-1 and WC-2 some distance beyond that dictated by the optimum or minimum stroke length discussed previously. This additional space contributes to the real or "practical" length of the stroke and establishes a practical cycle time. Stroke length therefore becomes a compromise between the hypothetical minimum die spacing in the insert position and eject position based on the length of insert clearance and eject clearance required to process a blank 600 and 600*a* and the practical consideration of machine component strength and longevity. It is considered reasonable to utilize a stroke length that can compete with existing commercial equipment which, generally speaking, produces parts at the rate of 300 parts per minute (150 reciprocations per minute).

Figure 7:
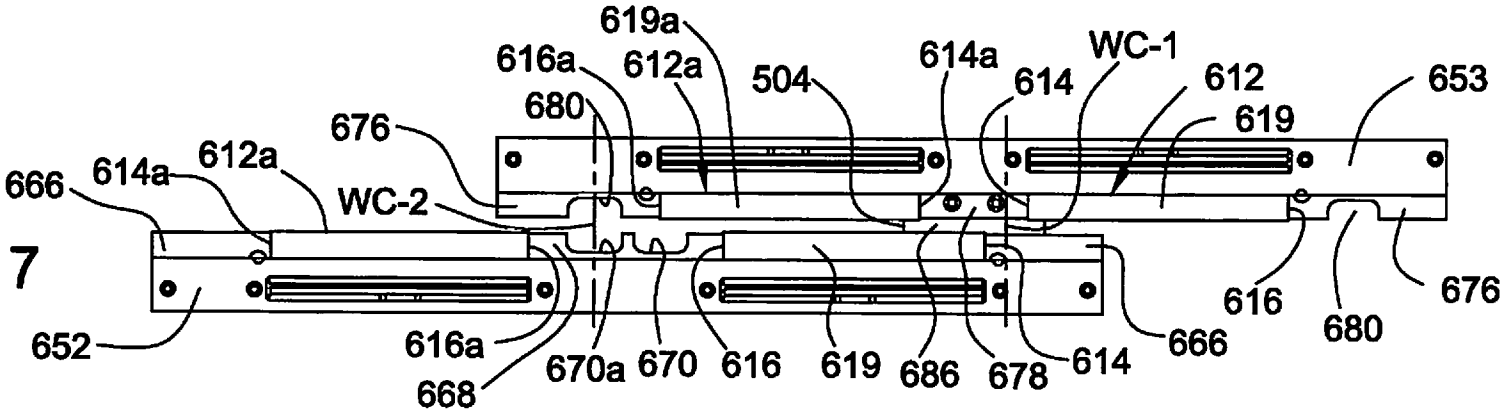
FIGS. 7 and 8 illustrate details of the die blocks positioned between dies of the machine as configured in FIG. 3, with dies of a different size as compared to FIGS. 1 and 2.
Figure 8:
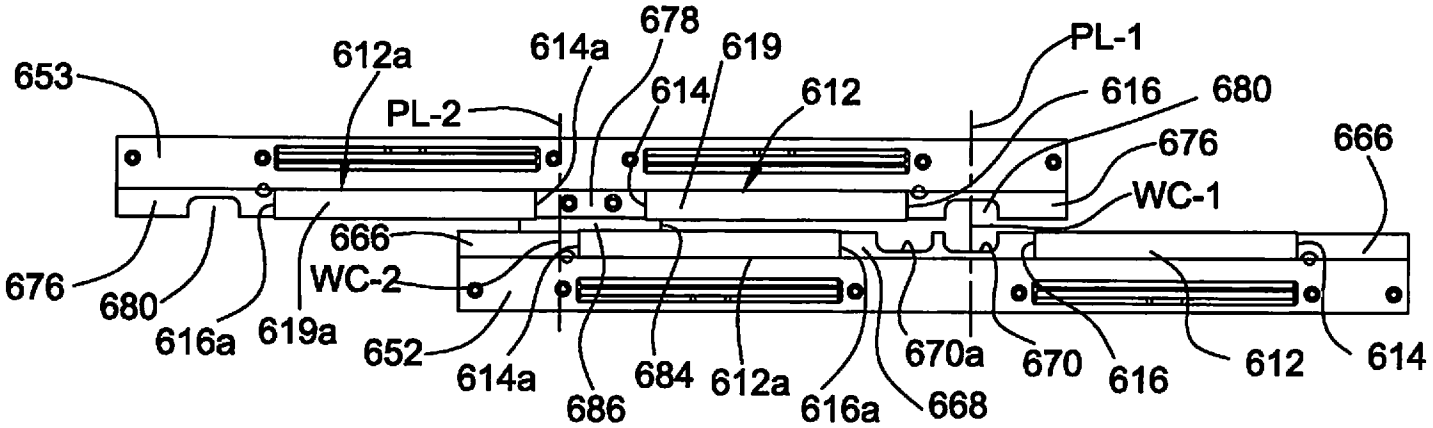

FIGS. 7 and 8 illustrate the arrangement of die holders 652 and 653 associated with shorter dies, discussed above, and illustrated in FIG. 3. The die holders 652 and 653 are illustrated in positions of programmed travel of slides 502 and 503, with holder 652 to the left in FIG. 7 (as also seen in FIG. 3) and to the right in FIG. 8. As in the illustration of die holders 552 and 553 in FIGS. 5 and 6, the die holders and dies are positioned at the insert position and eject position relative to the working centers of process WC-1 and WC-2. The distance between blank feeding stations, designated "F" throughout is fixed in the machine 500 and remains the same regardless of die size. In FIG. 7 the dies 612 are in the insert position and center of process WC-1 and dies 612*a* are in the eject position relative to WC-2. In FIG. 8, the dies 612*a* are in the insert position relative to working center of process WC-2 and the dies 612 are in the eject position with respect to working center WC-1. Since the dies 612 and 612*a* of FIGS. 7 and 8 are shorter than the dies 512 and 512*a* of the embodiment of FIGS. 5 and 6, the length of stroke of reciprocation is permissibly shorter. Given the constant position of blank feed locations or working centers of process WC-1 and WC-2 of a machine 500, accommodation must be made in the configuration of the die holders to take advantage of the cycle time reduction permitted by a reduction in length of stroke.

Die holder 653 includes an ejection slot 680 in each end block 676. This places an ejection slot adjacent the trailing edge 616 or 616*a* of each of the dies of sets 612 and 612*a* mounted in die holder 653 at about the same distance from the trailing edges 616 or 616*a* of each die 512 or 512*a* as in the embodiment of FIGS. 5 and 6.

Referring to die holder 652, the dies of sets 612 and 612*a* there are positioned with their trailing edges adjacent each other, separated by central block 668. The block 668, as in the case of central block 568 of die holder 552 of FIGS. 2, 4, 5 and 6, bears the load of the die of set 612 or 612*a* urged against it during roll forming. Conveniently, as seen in FIGS. 7 and 8, the block 668 is of significantly increased longitudinal length (along plane P) as compared to center block 568. The additional length derives from the fact that the distance between the trailing edges 516 and 516*a* of the dies on holder 652 increases by the amount of reduction in die length.

In this instance, a centrally positioned ejection slot, such as slot 570 in die holder 568 of the embodiment of FIGS. 2, 4, 5 and 6 would unnecessarily add to the length of stroke of rails 502 and 503 to align the discharge passage elements. Therefore, in the case of the central block 668 of die holder 652, the central block 668 is provided with two ejection slots 670 and 670*a*. Ejection slot 670*a* is positioned to align with ejection slot 680 at the left end of die holder 653 when the dies 612*a* are at the eject position relative to working center of process WC-2. Ejection slot 670 is positioned to align with ejection slot 680 at the right end of die holder 653 when the dies 612 are at the eject position relative to working center of process WC-1. The slot 670 and 670*a* are equally spaced from the transverse ends of block 668. The distance between the transverse mid-lines of the two ejection slots 670 and 670*a* of center block 668 is equal to the reduction in die length of dies 612 and 612*a* compared to dies 512 and 512*a* of the arrangement of FIG. 3.

Notably, the central block 678 on die holder 653 is also of an increased longitudinal length as compared to the longitudinal length of central block 578 of the arrangement of FIGS. 2, 5 and 6 (again by the length of the difference in the length of dies 612 and 612*a* compared to dies 512 and 512*a*). Therefore, there are two locations along the longitudinal length of block 678 that align with the insertion of a blank at WC-1 or WC-2 equally spaced from the transverse mid-line of block 678 and spaced apart a distance equal to the reduction in die length.

With this configuration the stroke of reciprocating rails 502 and 503 can be programmed to an efficient length consistent with the shorter die length and the spacing necessary to load blanks when the dies are at the insert position relative to WC-1 or WC-2 and clear completed parts from the working centers of process at an efficient reciprocation stroke.

Notably, die holders 652 and 653 of FIGS. 3 and 7 and 8 have a longitudinal length that is shorter than the length of die holders 552 and 553 illustrated in FIGS. 2 and 4, 5 and 6. This reduction in length results from the accommodation of dies of shorter length, but does not affect die position on each rail 502 and 503, given the constant distance between working centers of process WC-1 and WC-2 for machine 500.

Figure 9:
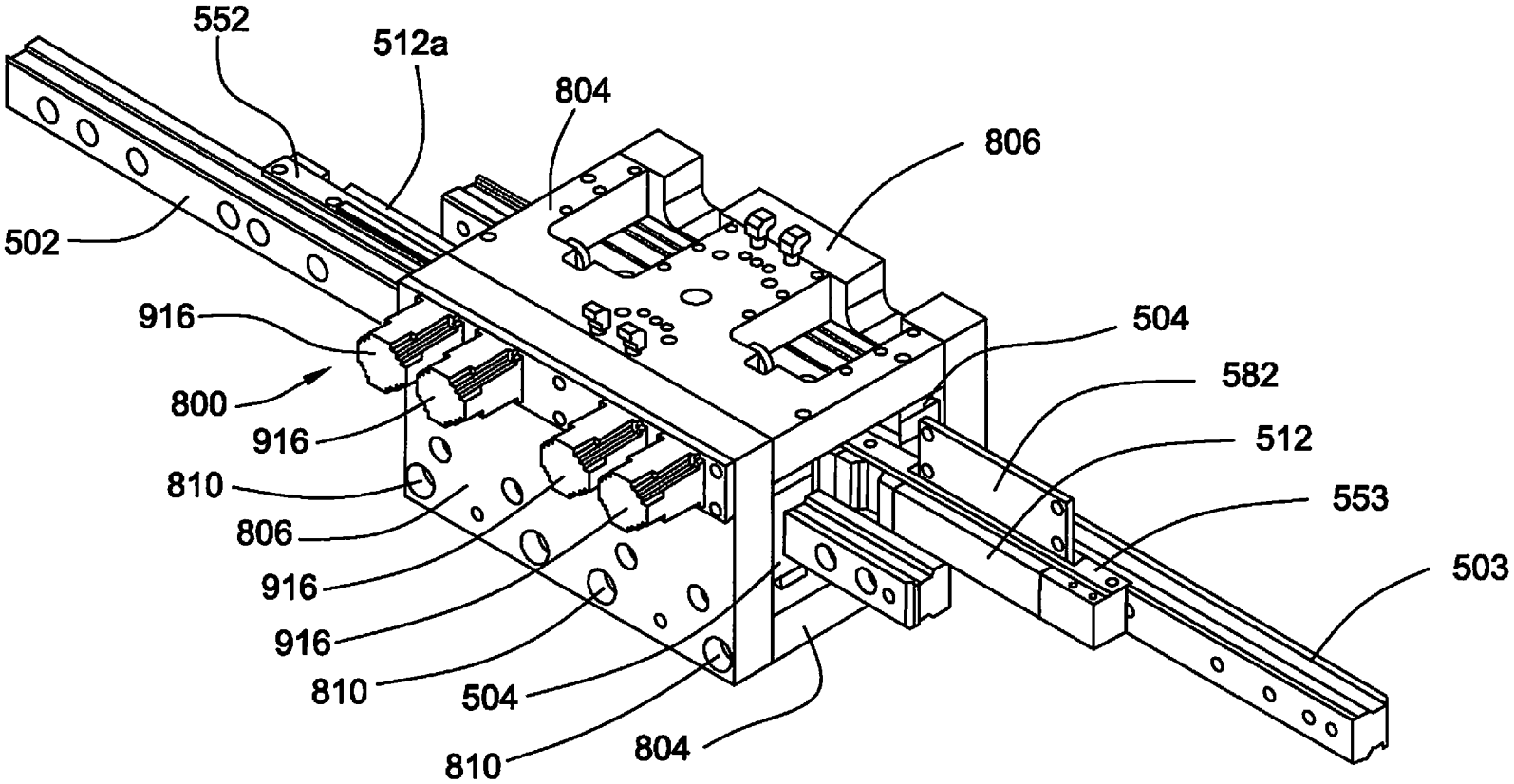
FIG. 9 illustrates the modular nature of the structure of the multi-station, reciprocating die, roll forming machine of the present disclosure.

FIG. 9 illustrates another advantageous feature of the multi-station reciprocating die roll forming machine of the present disclosure. Specifically, machine 500 of FIG. 1 provides a modular format, in which the pattern forming elements are contained completely preassembled and preset configuration in an integrated sub-assembly suitable for installation and removal from the power or drive elements.

Referring to FIG. 9, the forming component assembly is generally designated 800. As illustrated and in reference to FIGS. 1 and 2, the assembly 800 comprises all forming elements necessary to roll form blanks 600 and 600*a* at working centers of process WC-1 and WC-2. This includes the slide rails 502 and 503, the dies 512 and 512*a*, the die holders 552 and 553, and supporting bearing blocks 504. It could, alternatively, include the components illustrated in FIGS. 3, 7 and 8 employing shorter dies 612 and 612*a*.

The processing components are contained within a rigid frame formed by two horizontal steel plates 804 and two vertical steel plates 806 connected by suitable fasteners 810. These connected plates form a ring of strength about the forming elements supported within bearing blocks 504.

In this arrangement, the high precision relationships between the working faces 518 and 518*a* of die sets 512 and 512*a* can be pre-established using the transverse adjustment mechanism explained in reference to FIG. 4. Similarly, the precision relationship between the slide rails 502 and 503 with attached dies carried by die holders 552 and 553 is established on bearing blocks 504 relative to longitudinal plane P and the working center of process WC-1 and WC-2. This preset configuration is maintained by the ring of strength defined by connected plates 804 and 806.

The forming component assembly 800 may be supported on, or removed from the base 501 of machine 500 as an integrated unit. Slides or rails 502 and 503 are connected to the drive belts 505 and 506 for powered operation by servo-motors 510. Appropriate sensing and control connections to the central processing unit 509 and control panel 511 complete the installation.

The assembly 800 may be removed intact without disturbing any of the precision relationships critical to successful roll forming. A different forming component assembly 800 may then be substituted upon the machine base 501 for processing of other blanks. In each instance, the forming component assembly is preset for roll forming parts of particular size and dimension. Installation and removal of the assembly 800 is accomplished without disturbing those precision relationships within the frame defined by plates 804 and 806.

Of course it is not necessary to replace the entire forming component assembly as a unit. As explained earlier, the operation of the servo-motors 510 is controlled by the central processing unit that receives instruction from the operator touch screen 509. Each motor, and consequently each rail 502 and 503, is capable of translative movement independently of the other. It is, therefore, possible to cause the rails 502 and 503 to move to a position relative to the rigid frame and associated bearing blocks 504 to provide access to the die holders 552 and 553 or 652 and 653. The die holders, or dies within the die holders may be readily changed for production of a product of a different size or configuration.

Figure 10:
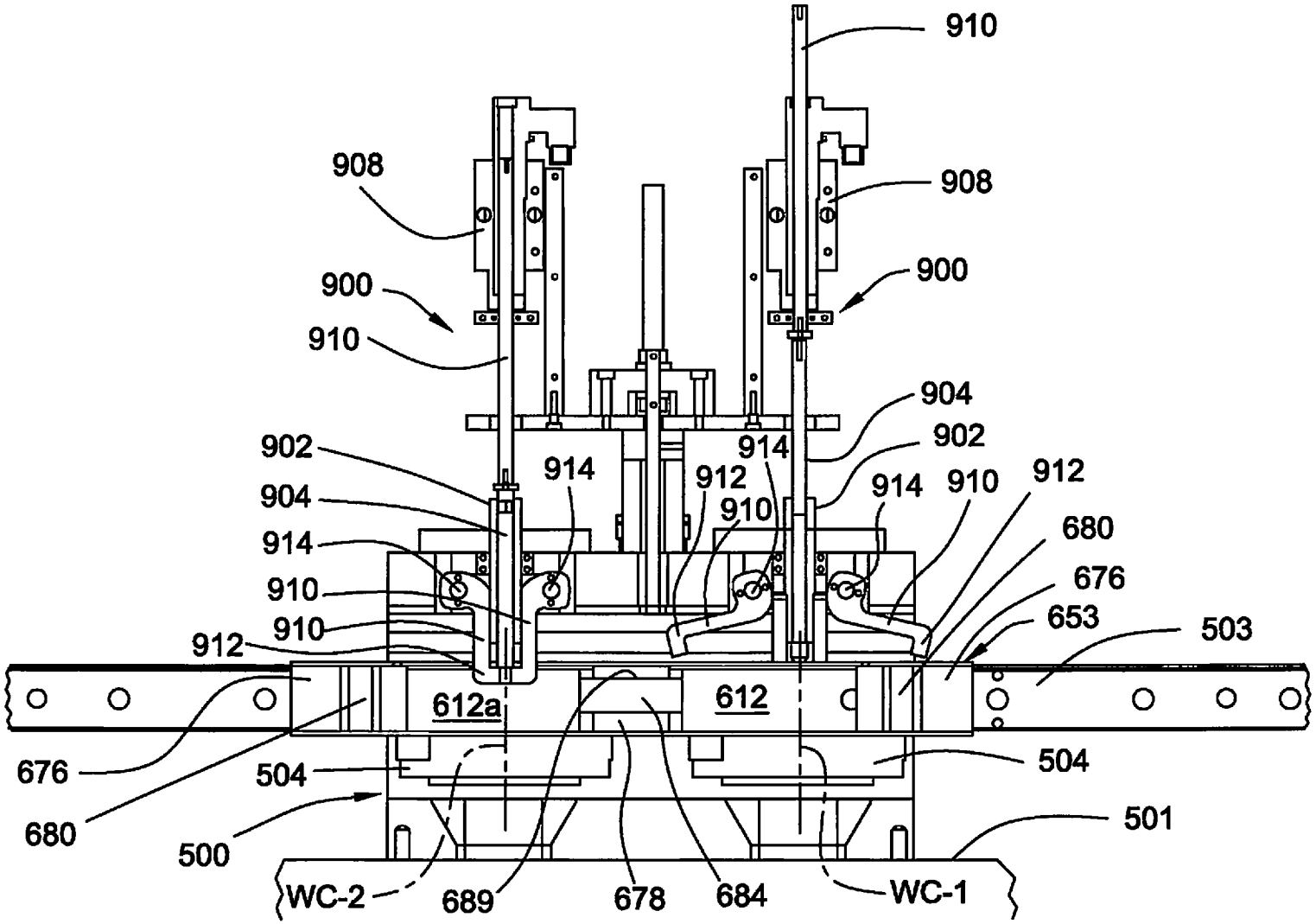
FIG. 10 is a longitudinal sectional view illustrating the blank delivery system of the multi-station, reciprocating die, roll forming machine of FIG. 1.
Figure 11:
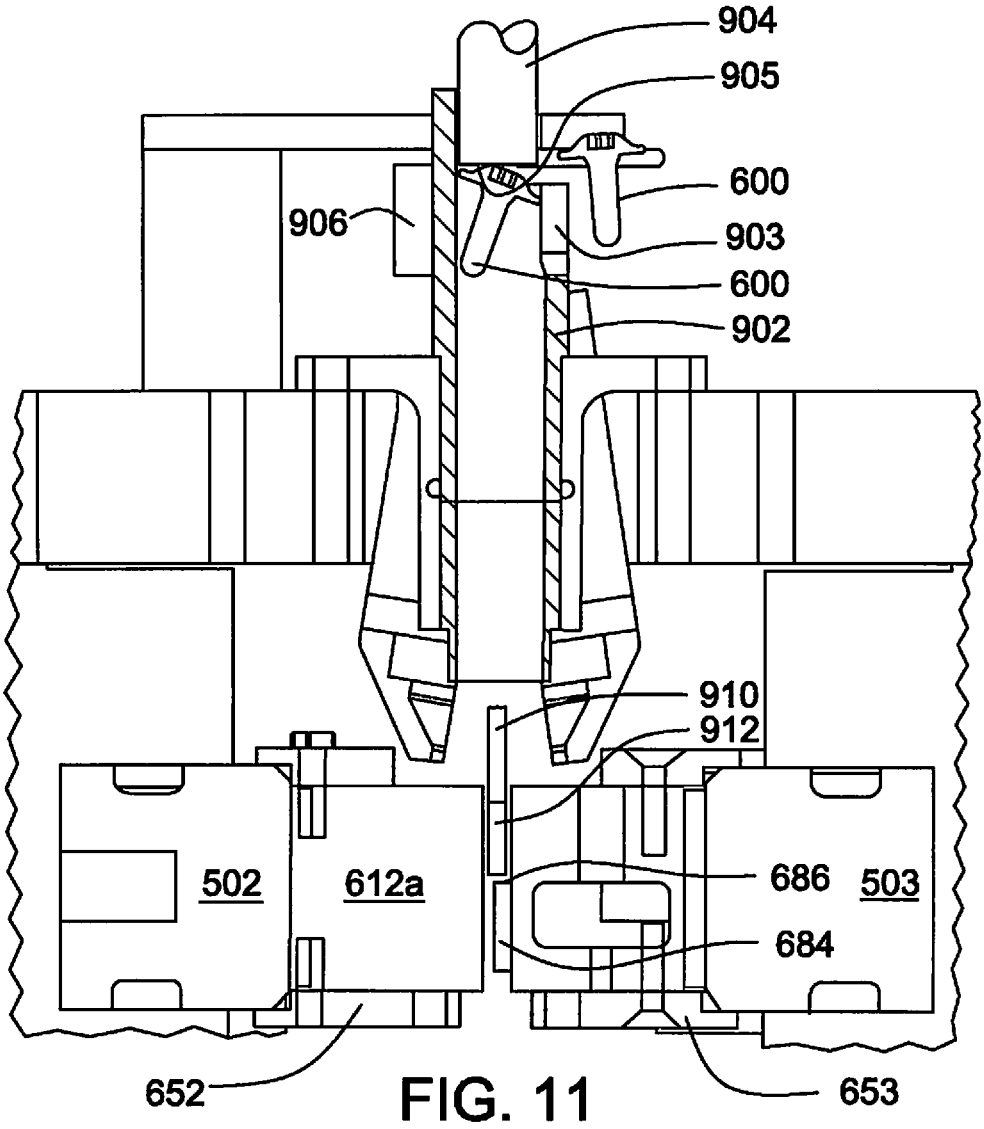
FIG. 11 is a transverse sectional view of a portion of the blank delivery system of FIG. 10 in a particular position.
Figure 12:
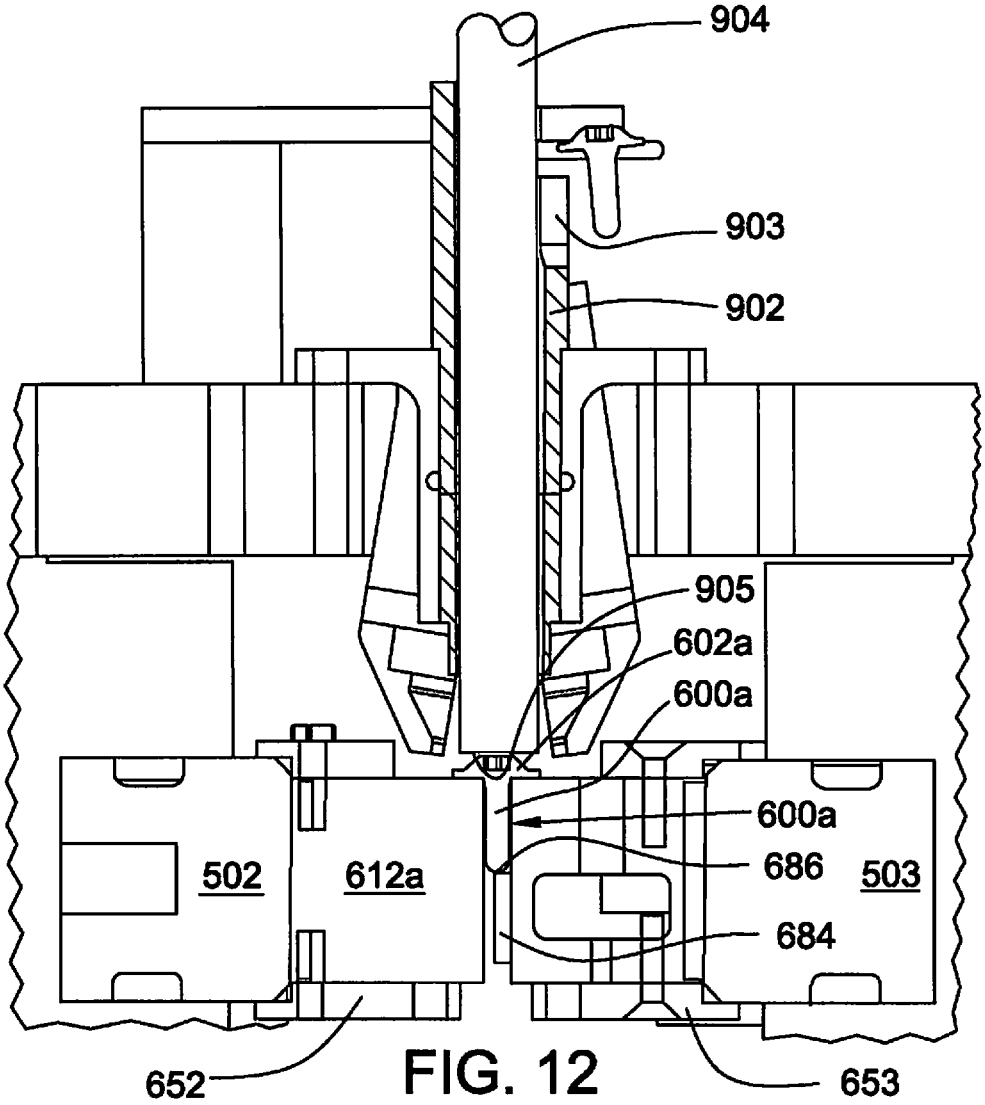
FIG. 12 is a transverse sectional view of a portion of the blank delivery system shown in FIG. 10 illustrating another position.

FIGS. 10 through 12 illustrate a blank delivery system generally designated 900 that includes the additional capability of position sensing and feedback. It provides the advantage of recognition of positioning of a blank 600 or 600*a* being formed at the center of process WC-1 or WC-2 along with a process control function to enhance machine productivity. Note that one such blank delivery system 900 is associated with each center of process location WC-1 and WC-2.

The blank delivery systems illustrated in FIGS. 10 through 12 are shown in association with dies 612 and 612*a* carried upon rails 502 and 503 by holders 652 and 653. This die configuration is seen in FIGS. 3, 7 and 8.

FIGS. 10 to 12 illustrate another variation of vertical insertion limit for blanks 600 or 600*a*. This feature is also seen in FIGS. 5 through 8. The center blocks 578 of die holder 553 of the embodiment of FIGS. 5 and 6 and 678 of die holder 653 of FIGS. 7 and 8 each include a vertical plate 584 in FIGS. 5 and 6 and 684 in FIGS. 7, 8 and 10 to 12. It extends across plane P and includes a horizontal ledge 586 (or 686) that is positioned to limit vertical insertion of a blank 600 or 600*a* at the insert position of dies 612 and 612*a* relative to a working center of process WC-1 or WC-2. The transverse thickness of plate 584 or 684 is such that it passes between the dies during reciprocation of rails 502 and 503. The transverse width, and its longitudinal length are such that it supports a blank at the working center of process until the blank is captured between the loading edges of the dies as die reciprocation commences. Plates 584 of 684 may have sufficient longitudinal length along plane P that the blank is supported during the pattern forming process. This arrangement is particularly useful in instances where the blank does not include an enlarged head that can be captured at the upper planar surfaces 519 or 519*a* or 619 or 619*a* of the forming dies.

FIG. 10 shows a vertical blank supply tube 902 aligned with each center of process WC-1 and WC-2. The control system represented by the central processing unit 509 provides blank delivery timing control. A plunger 904 with a bottom end 905 is reciprocal within each tube 902 to deliver a blank such as blank 600 or 600*a* to each forming station at WC-1 and WC-2 as required, and when dictated by the timing of die reciprocation. As shown in detail in FIG. 11, blanks, for example blank 600 are supplied to tubes 902 by conventional means from a supply (not shown) through a slot 903 in each tube 902. A magnet 900 may be affixed to the exterior of tube 902 to ensure proper delivery position for blank relative to tube 902 on insertion through slot 903. Notably, plungers 904 may be biased in a vertically upward direction to nominally reside above slot 903.

Referring to FIG. 10, as illustrated, each plunger 904 is operated by a linear servo-motor 908 with a reciprocal armature 910. Each linear servo-motor 908, in response to an appropriate input from central processing unit 509 activates its reciprocal armature 910 to urge plunger 904 downward to deliver a blank 600 or 600*a* to the working center of process. This action occurs when the associated dies 612 or 612*a* are in the insert position (as previously discussed) at that processing station. Of course, pneumatic cylinders could be used to urge the plungers 904 downward.

FIG. 10 left side, and FIG. 12 illustrates the position of blank 600*a* in place between dies 612*a* approximately midway through a forming stroke for forming a thread on the cylindrical pattern receiving surface 601*a*. The blank was delivered there by activation of linear servo-motor 908. Its vertical position was established when the dies 612*a* were in the insert position, with leading edges 614*a* of the dies spaced from transverse plane PL-2 by the amount of insert clearance (insert position).

As illustrated in FIG. 12, during rolling of the pattern upon the cylindrical pattern receiving surface 601*a*, the linear servo-motor 908 maintains the bottom end 905 of plunger 904 in closely spaced monitoring relation to the enlarged head 602*a* of blank 600*a*. Any tendency of the blank to rise vertically relative to dies 612*a* is recognized by the linear servo-motor 908 which acts as a sensor with input to the central processing unit. The processing unit 509 may then provide an output signal to initiate some responsive action. It is also contemplated that when the dies 612 or 612*a* are in the eject position at a center of process WC-1 or WC-2, the associated servo-motor 908 may be activated to extend plunger 904 to impart a discharge force to the patterned blank 600 or 600*a*.

Referring to FIG. 10, each blank of delivery system 900 feeding station, as previously described with respect to the embodiment of FIGS. 1 and 2, includes pivotal locating arms 910 with locating fingers 912 to position a blank at the center of process WC-1 and WC-2. Here the pivotal locating arms 910 are mounted for pivotal movement above the reciprocal slide rails 502 and 503 and dies 612 and 612*a* carried by die holders 652 and 653. Each is attached to a rotatable shaft 914 driven by a servo-motor 916 seen in FIG. 10.

As seen in FIGS. 10 to 12, the pivotal location arms 910 are positioned along plane P, between the die pattern forming surfaces 618 and 618*a*. They pivot longitudinally along plane P to engage and disengage locating fingers 912 with the cylindrical pattern forming surface 601 or 601*a* of blanks 600 or 600*a*.

The pivotal locating arms 910 are driven by servo-motors 916 in response to signals from the central processing unit to capture a blank 600 or 600*a* at a working center of process WC-1 or WC-2 when the leading edges 614 or 614*a* of the dies are at the insert position relative to that working center of process. The blank is thereby maintained at the working center of process until its pattern receiving surface 601 or 601*a* is engaged by the leading edges 614 and 614*a* of dies 612 or 612*a*, all as previously described with respect to the embodiments of FIGS. 1 to 3.

Figure 13:
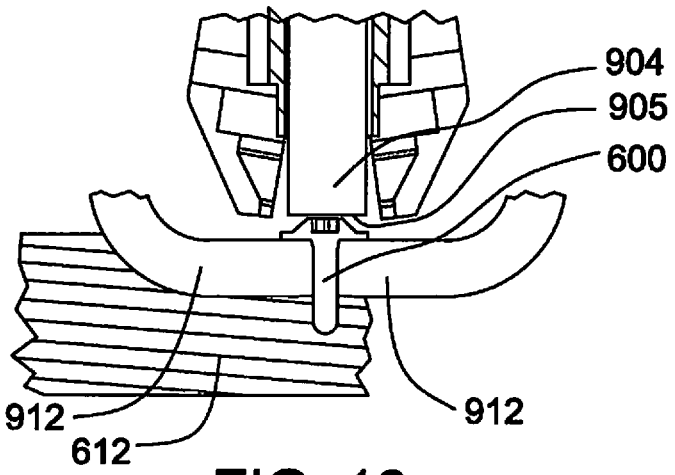
FIG. 13 is a fragmentary view, on an enlarged scale, of portion of the blank delivery system of FIGS. 10 to 12 illustrating feedback features of the system.

In the embodiment represented in FIGS. 10 to 12, and as illustrated in FIG. 13 during pattern forming, the locating fingers 912 are kept in closely spaced facing relation to the pattern receiving surface 601 or 601*a*. The spacing is such that the blank freely rotates during advancement of the dies through the formation of a pattern. However, the locating fingers 912 and pivotal locating arms 910, by virtue of their proximity to the rotating blank and their powered connection to servo-motor 916, act as sensors to determine the position of a blank relative to the moving die faces 618 and 618*a*. The fingers 912 and arms 910 provide feedback to motors 916 should contact be made with a blank. The servo-motor may then deliver an appropriate signal to the central processing unit 509 for evaluation and possible delivery of an output signal to the servo-motors 510.

The foregoing monitoring function maintains a control on the forming process based on recognition of the position and orientation of a blank 600 or 600*a* relative to the forming dies 612 and 612*a* (or in the instance of FIG. 2, forming dies 512 and 512*a*). By this arrangement, recognition of any deviation in position or attitude of a blank can be utilized to warn an operator of a possible malfunction, cause discard of the blank or act to terminate the forming process. The machine 500 may then be examined and adjusted to assure production of useful patterned parts.

Preferred embodiments of this invention are described herein. Variations of those preferred embodiments may become apparent to those of ordinary skill in the art upon reading the foregoing description. Accordingly, this invention includes all modifications and equivalents of the subject matter recited in the claims appended hereto as permitted by applicable law.

The invention claimed is:

1. A multi-station, reciprocating die, pattern forming machine, including a pair of reciprocal slide members movable along parallel paths on opposite sides of a longitudinal plane with spaced pairs of pattern forming dies thereon reciprocal between an insert position and an eject position relative to an associated center of process within said longitudinal plane and spaced planes perpendicular thereto, drive mechanism to reciprocate the dies between said insert position and said eject position, mechanism to deliver and position a pattern receiving blank at the center of process associated with a pair of dies when said dies of a pair are in said insert position, axial translation of said dies from said insert position to said eject position causing said dies to rotate the blank at said center of process and impart a pattern upon the blank and release a patterned part when said dies are in said eject position, wherein each reciprocal slide member includes a die holder attached thereto, each said die holder comprising spaced end blocks and a center block connected to said slide member and defining die receiving pockets.

2. A multi-station, reciprocating die, pattern forming machine as claimed in claim 1, wherein said slide members are reciprocal between fully retracted and fully inserted positions, wherein, when said slide members are in said fully retracted position, one of said pairs of dies are in said insert position and the other of said pairs of dies are in said eject position and when said slide members are in said fully inserted position said one of said pairs of dies are in said eject position, and said other of said pairs of dies are in said insert position.

3. A multi-station, reciprocating die, pattern forming machine as claimed in claim 2, wherein each die of each said pair of dies includes a leading edge, a trailing edge and a pattern forming face in facing relation to the pattern forming face of the other die of said pair, and wherein, in said insert position, said leading edge of said dies of a pair are equidistant from the associated center of process and spaced apart a distance sufficient to receive a blank therebetween and wherein, in said eject position, said trailing edges of said dies of a pair are spaced apart a distance sufficient to discharge a patterned part therefrom.

4. A multi-station, reciprocating die, pattern forming machine as claimed in claim 3, wherein the length of the stroke of the reciprocal slide member between said fully retracted position and the fully inserted positions is equal to the length of the pattern forming face of a die plus one-half the distance between the leading edges of the dies of a pair in said insert position and one-half the distance between the trailing edges of the dies in said eject position.

5. A multi-station, reciprocating die, pattern forming machine as claimed in claim 3, wherein each of said reciprocal slide members includes one die of each spaced pairs of dies and, wherein the dies on one slide member are disposed with the trailing edges of one die facing the trailing edge of the other die on said slide member and the dies on the other slide member are disposed with the leading edge of one die facing the leading edge of the other die on said other slide member.

6. A multi-station, reciprocating die, pattern forming machine as claimed in claim 5, wherein on the slide member having dies disposed with the leading edges of the dies in facing relation, the distance between the leading edge of one die and the trailing edge of the other die is equal to the distance between the centers of process plus one-half the spacing between dies of a pair in the insert position less one-half the distance between dies of a pair in the eject position and wherein on the slide member having dies disposed with the trailing edges of the dies in facing relation the distance between the leading edge of one die and the trailing edge of the other die is equal to the distance between the centers of process plus one-half the distance between the trailing edges of the dies of a pair in the eject position less one-half the distance between the leading edges of the dies of a pair in the insert position.

7. A multi-station, reciprocating die, pattern forming machine as claimed in claim 1, wherein said pattern on said pattern forming dies is a thread pattern.

8. A multi-station, reciprocating die, pattern forming machine as claimed in claim 1, wherein said center block of said die holder of one of said die holders is longer in the direction of reciprocation of said slide members than the center block of the die holder of the other of said slide members and wherein the longer center block includes a surface in contact with a surface of the dies adjacent the trailing edges of the dies.

9. A multi-station, reciprocating die, pattern forming machine as claimed in claim 1, wherein said longer center block includes at least one discharge slot and the end blocks of the die holder on the other slide member each include a discharge slot.

10. A multi-station, reciprocating die, pattern forming machine as claimed in claim 1, wherein a die back plate is disposed in each die pocket between each die and the slide member to which said die holder is connected and plurality of shim buttons are disposed between each die and each said back plate and wherein a die shim plate is disposed between each said die and each said back plate, said die shim plates including receptacles with said shim buttons disposed in said receptacles.

11. A multi-station, reciprocating die, pattern forming machine as claimed in claim 1, wherein said delivery and positioning mechanism includes a pair of reciprocal plungers each aligned with one of the centers of process, and operable when said dies of a pair of dies is positioned in the insert position to deliver a blank to a center of process between said dies.

12. A multi-station, reciprocating die, pattern forming machine as claimed in claim 11, wherein each said plunger is reciprocal by a servo-motor and is arranged to remain in closely spaced relation to the delivered blank during movement of the pair of dies from said insert position to said eject position, said servo-motor providing feedback based on movement of the blank.

13. A multi-station, reciprocating die, pattern forming machine as claimed in claim 1, wherein said delivery and positioning mechanism includes reciprocal arms having fingers operable when said dies of a pair of dies are positioned in the insert position to reciprocate toward a blank therebetween to position said blank at the center of process.

14. A multi-station, reciprocating die, pattern forming machine as claimed in claim 13, wherein said arms are reciprocal by servo-motors and said fingers are arranged to remain in closely spaced relation to the delivered blank during movement of said pair of dies from said insert position to said eject position and said servo-motors providing feedback based on movement of the blank.

15. A reciprocating die, pattern forming machine, including a pair of reciprocal slide members movable along parallel paths on opposite sides of a longitudinal plane with at least one pair of pattern forming dies thereon reciprocal between an insert position and an eject position relative to an associated center of process within said longitudinal plane and a plane perpendicular thereto, drive mechanism to reciprocate said dies between said insert position and said eject position, mechanism to deliver and position a pattern receiving blank at the center of process associated with said at least one pair of dies when said dies of said pair are in said insert position, axial translation of said dies from said insert position to said eject position causing said dies to rotate the blank at said center of process and impart a pattern upon the blank and release a patterned part when said dies are in said eject position, wherein said delivery and positioning mechanism includes reciprocal arms having fingers operable when said dies of said at least one pair of dies are positioned in the insert position to reciprocate toward a blank therebetween to position said blank at the center of process, wherein said arms are reciprocal by servo-motors and said fingers are arranged to remain in closely spaced relation to the delivered blank during movement of said at least one pair of dies from said insert position to said eject position, said servo-motors providing feedback based on movement of the blank, and wherein each reciprocal slide member includes a die holder attached thereto, each said die holder comprising spaced end blocks and a center block connected to said slide member and defining die receiving pockets.

16. A reciprocating die, pattern forming machine as claimed in claim 15, wherein said delivery and positioning mechanism includes a reciprocal plunger operable when said dies of said at least one pair of dies is positioned in the insert position to deliver a blank to the center of process between said dies, and wherein said plunger is reciprocal by a servo-motor and is arranged to remain in closely spaced relation to the delivered blank during movement of said at least one pair of dies from said insert position to said eject position, said servo-motor providing feedback based on movement of the blank.

17. A method of patterning blanks using a multi-station, reciprocating die, pattern forming machine comprising:

a pair of reciprocal slide members movable along parallel paths on opposite sides of a longitudinal plane with spaced pairs of pattern forming dies thereon reciprocal between an insert position and an eject position relative to an associated center of process within said longitudinal plane and spaced planes perpendicular thereto, wherein each reciprocal slide member includes a die holder attached thereto, each said die holder comprising spaced end blocks and a center block connected to said slide member and defining die receiving pockets;

a drive mechanism to reciprocate the dies between said insert position and eject position and a mechanism to deliver and position a pattern receiving blank at the center of process associated with a pair of dies in the insert position, said method comprising:

delivering a blank to a center of process when said dies associated with said center of process are in said insert position; and axially translating said dies from said insert position to said eject position and causing said dies to rotate the blank at said center of process and impart a pattern upon the blank and release a patterned part from said center of process when said dies are in said eject position.

18. A method of patterning blanks using a multi-station, reciprocating die, pattern forming machine as claimed in claim 17, wherein said delivery and positioning mechanism includes a pair of reciprocal plungers each aligned with one of the centers of process, and operable when said dies of a pair are positioned in the insert position to deliver a blank between said dies, and wherein each said plunger is reciprocal by a servo-motor and arranged to remain in closely spaced relation to a delivered blank during movement of a pair of dies from said insert position to said eject position, and wherein said delivery and positioning mechanism includes reciprocal arms having fingers operable when said dies of each pair of dies are positioned in the insert position to reciprocate toward a blank therebetween to position said blank at the center of process, and wherein said arms are reciprocal by servo-motors and said fingers are arranged to remain in closely spaced relation to the delivered blank during movement of said pair of dies from said insert position to said eject position, said method further comprising monitoring the position of the blank with said plunger and said fingers during movement of said dies from said insert position to said eject position.

19. A multi-station, reciprocating die, pattern forming machine, including a pair of reciprocal slide members movable along parallel paths on opposite sides of a longitudinal plane with spaced pairs of pattern forming dies thereon reciprocal between an insert position and an eject position relative to an associated center of process within said longitudinal plane and spaced planes perpendicular thereto, wherein each reciprocal slide member includes a die holder attached thereto, each said die holder comprising spaced end blocks and a center block connected to said slide member and defining die receiving pockets, wherein each die of each said pair of dies includes a leading edge, a trailing edge and a pattern forming face in facing relation to the pattern forming face of the other die of said pair, and wherein, in said insert position, said leading edge of said dies of a pair are equidistant from the associated center of process and spaced apart a distance sufficient to receive a blank therebetween and wherein, in said eject position, said trailing edges of said dies of a pair are equidistant from the associated center of process and spaced apart a distance sufficient to discharge a patterned part therefrom, drive mechanism to reciprocate the dies between said insert position and eject position, mechanism to deliver and position a pattern receiving blank at the center of process associated with a pair of dies when said dies of a pair are in said insert position, axial translation of said dies from said insert position to said eject position causing said dies to rotate the blank at said center of process and impart a pattern upon the blank and release a patterned part when said dies are in said eject position, wherein said delivery and positioning mechanism includes a pair of reciprocal plungers each aligned with one of the centers of process, and operable when said dies of a pair of dies are positioned in the insert position to deliver a blank to a center of process between said dies, wherein said plunger is reciprocal by a servo-motor and is arranged to remain in closely spaced relation to the delivered blank during movement of the pair of dies from said insert position to said eject position, said servo-motor providing feedback based on movement of the blank, wherein said delivery and positioning mechanism includes reciprocal arms having fingers operable when said dies of a pair of dies are positioned in the insert position to reciprocate toward a blank therebetween to position said blank at the center of process, and wherein said arms are reciprocal by servo-motors and said fingers are arranged to remain in closely spaced relation to the delivered blank during movement of said pair of dies from said insert position to said eject position and said servo-motors providing feedback based on movement of the blank.

* * * * *